US005158377A

United States Patent [19]

Suzuki et al.

[11] Patent Number: 5,158,377

[45] Date of Patent: * Oct. 27, 1992

[54] INK-SUPPLY SYSTEM FOR A DOT MATRIX PRINTER

[75] Inventors: Takashi Suzuki; Masanao Matsuzawa; Yoshinori Miyazawa, all of Shiojiri, Japan

[73] Assignee: Seiko Epson Corporation, Nagano, Japan

[ * ] Notice: The portion of the term of this patent subsequent to Nov. 13, 2007 has been disclaimed.

[21] Appl. No.: 620,411

[22] Filed: Nov. 30, 1990

Related U.S. Application Data

[60] Division of Ser. No. 612,010, Nov. 9, 1990, which is a continuation of Ser. No. 401,539, Aug. 31, 1989, Pat. No. 4,969,759, which is a continuation of Ser. No. 161,216, Feb. 17, 1988, abandoned, which is a continuation of Ser. No. 35,251, Mar. 23, 1987, abandoned, which is a continuation of Ser. No. 873,871, Jun. 12, 1986, abandoned, which is a continuation of Ser. No. 659,816, Oct. 11, 1984, abandoned.

[30] Foreign Application Priority Data

| | | | |
|---|---|---|---|
| May 22, 1984 | [JP] | Japan | 59-102841 |
| May 22, 1984 | [JP] | Japan | 59-102842 |
| May 22, 1984 | [JP] | Japan | 59-102843 |

[51] Int. Cl.[5] ..... B41J 2/305

[52] U.S. Cl. ..... 400/124; 400/470

[58] Field of Search .....400/124 IW, 470, 471, 400/471.1, 126; 346/140 R, 140 PD; 101/97, 98, 333, 335, 364

[56] References Cited

U.S. PATENT DOCUMENTS

| | | | |
|---|---|---|---|
| 2,585,647 | 2/1952 | Gordon | 118/265 |
| 2,747,543 | 5/1956 | Navikas | 118/264 |
| 3,018,756 | 1/1962 | Kilham | 118/264 |
| 3,097,597 | 7/1963 | Visser | 101/364 |
| 3,101,667 | 8/1963 | Siegel | 101/364 |
| 3,441,950 | 4/1969 | Miller | 346/140 |
| 3,599,566 | 8/1971 | Fish | 101/364 |
| 4,095,237 | 6/1978 | Amberntsson et al. | 346/140 |
| 4,194,846 | 3/1980 | Zerillo | 400/124 |
| 4,279,519 | 7/1981 | Shiurila | 400/124 |
| 4,336,767 | 6/1982 | Wada | 118/264 |
| 4,353,654 | 10/1982 | Shiurila | 400/124 |
| 4,400,102 | 8/1983 | Shiurila et al. | 400/124 |
| 4,403,874 | 9/1983 | Payne et al. | 400/124 |
| 4,456,393 | 6/1984 | Gomi et al. | 400/124 |
| 4,484,827 | 11/1984 | Price, Jr. | 101/335 |
| 4,794,409 | 12/1988 | Goger et al. | 346/140 PD |
| 4,968,998 | 11/1990 | Allen | 400/470 |
| 5,056,433 | 10/1991 | Murphy et al. | 101/364 |

FOREIGN PATENT DOCUMENTS

| | | | |
|---|---|---|---|
| 2546835 | 4/1977 | Fed. Rep. of Germany | 400/124 |
| 42874 | 3/1980 | Japan | 400/470 |
| 185168 | 11/1982 | Japan | 400/240.4 |
| 89377 | 5/1983 | Japan | 400/82 |
| 188670 | 11/1983 | Japan | 400/240.4 |

*Primary Examiner*—David A. Wiecking
*Attorney, Agent, or Firm*—Blum Kaplan

[57] ABSTRACT

An ink-supply system for a dot matrix printer including an ink-supply tank formed with an ink supply delivery port having an opening for passage of ink from the ink-supply tank. An ink absorbing member formed of a porous material is mounted within the ink-supply tank and compressed relative to at least another region of the ink absorbing member at least in the region thereof facing the opening of the ink supply delivery port.

114 Claims, 6 Drawing Sheets

FIG. 4
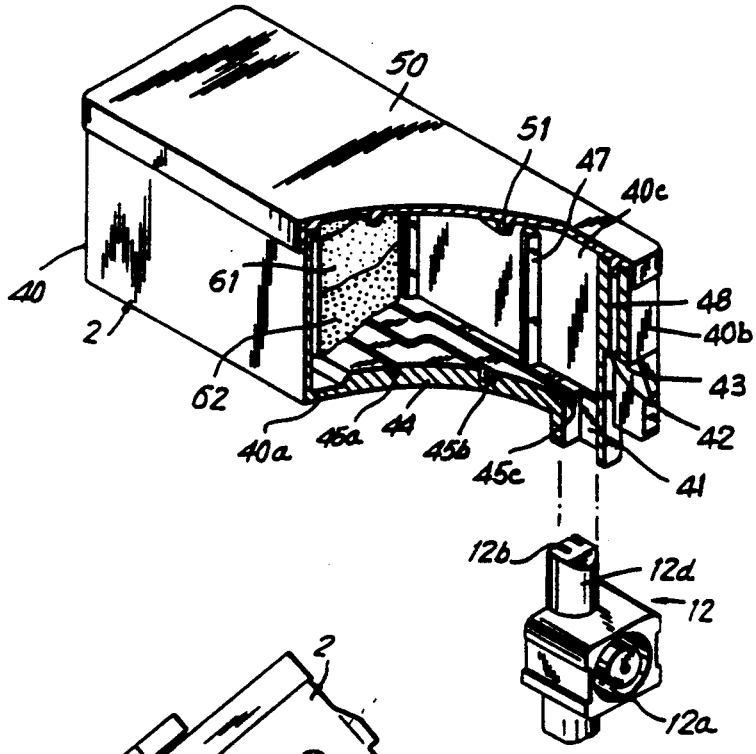
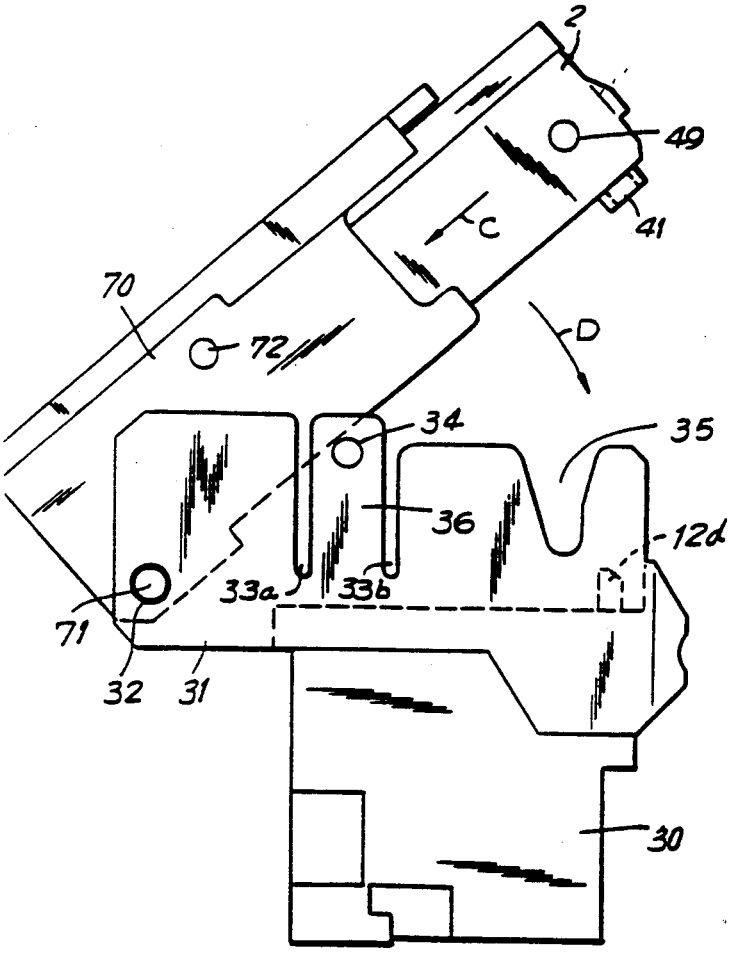
FIG. 5

FIG. 6
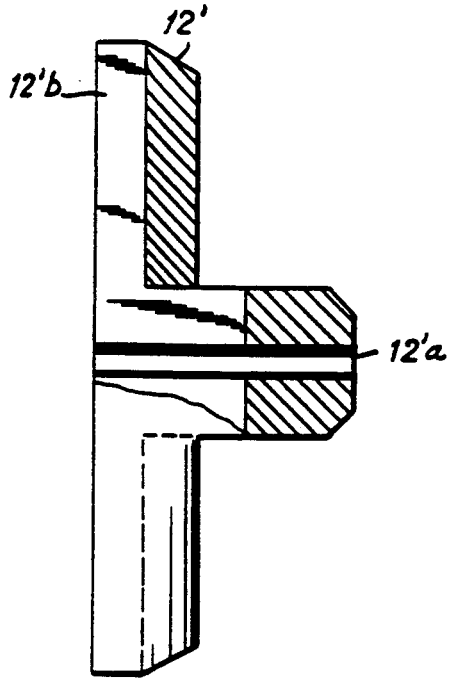
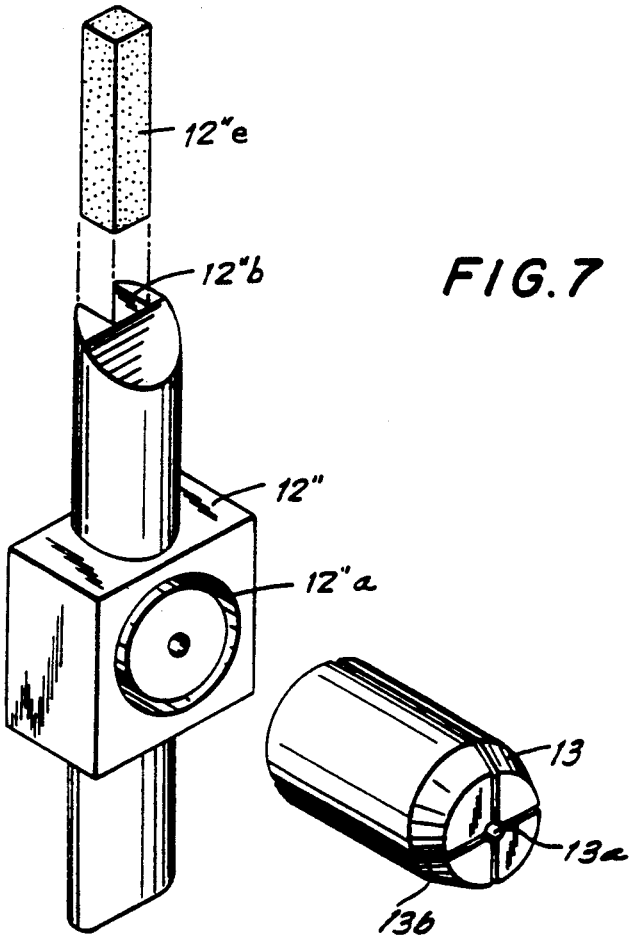
FIG. 7

FIG.8
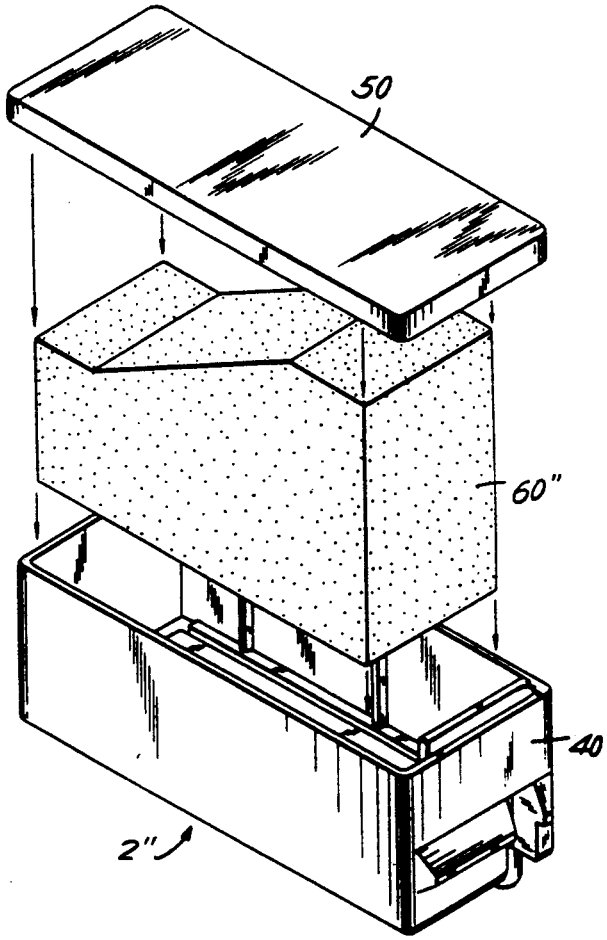
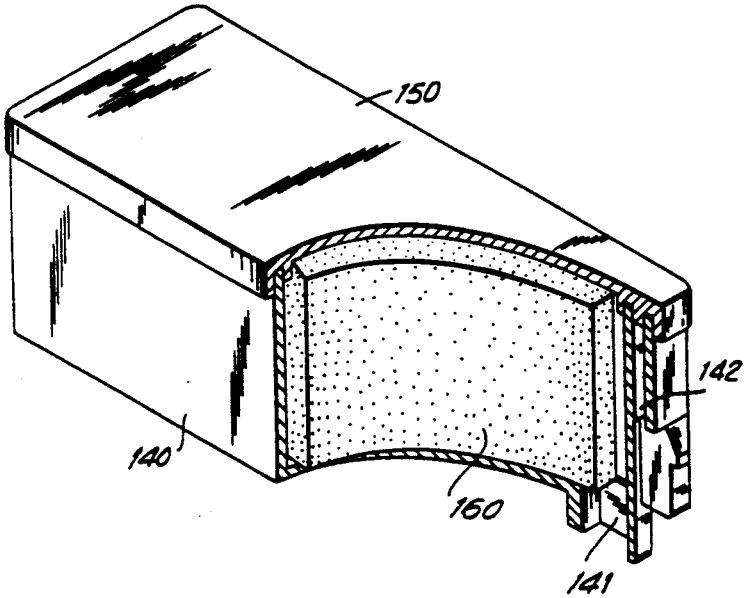
FIG.9

INK-SUPPLY SYSTEM FOR A DOT MATRIX PRINTER

This is a division of application Ser. No. 07/612,010 filed on Nov. 9, 1990, entitled INK-SUPPLIED WIRE DOT MATRIX PRINTER HEAD, currently pending, which is a continuation of application Ser. No. 07/401,539 filed on Aug. 31, 1989, which issued as U.S. Pat. No. 4,969,759 on Nov. 13, 1990, which is a continuation of application Ser. No. 07/161,216 filed on Feb. 17, 1988, now abandoned, which is a continuation of application Ser. No. 07/035,251 filed on Mar. 23, 1987, now abandoned, which is a continuation of application Ser. No. 06/873,871 filed on Jun. 12, 1986, now abandoned, which is a continuation of application Ser. No. 06/659,816 filed on Oct. 11, 1984, now abandoned.

BACKGROUND OF THE INVENTION

1. Field of the Invention

The present invention relates to an ink-supplied wire dot matrix printer head having wires supplied with ink at their distal end faces and movable against a sheet of print paper for transferring ink to the sheet in the form of dots to record a character, a figure, a graphic image or the like on the sheet, and more particularly to the construction of an ink tank and an ink guide for guiding ink from the ink tank to the distal end faces of the wires.

2. Description of the Prior Art

Ink supply systems for a wire dot matrix printer are known in which no ink ribbon is used, but ink is supplied from an ink tank to the distal ends of the wire and transferred from the wires directly to a sheet of print paper. One known ink guide mechanism for such an ink supply system is disclosed in U.S. Pat. No. 4,194,846 and comprises a porous member capable of absorbing ink and for guiding ink from an ink tank with wires contacting the porous member. The porous member contains fine holes with their sizes or diameters varying within a certain range, with the result that the ink absorbing capability varies from porous member to porous member, and excessive and insufficient quantities of ink tend to be supplied to the distal ends of the wire. The quantities of ink retained in the vicinity of the distal ends of the wires widely differ, and the porous member is liable to vary in dimensions or be deformed due to coaction with the sides of the wires. Therefore, the ink densities of formed dots are irregular.

U.S. Pat. No. 4,456,393 discloses another ink supply mechanism in which ink is supplied by a pump from an ink tank to the distal ends of wires. The disclosed ink supply mechanism is disadvantageous in that the construction of a joint between the pump and a printer head is complex and results in an increased cost. It is necessary to provide a sufficient seal so as to gain sufficient pump performance and a large-torque drive source is required for driving the pump. The ink supply mechanism is rendered particularly complex for a multicolor printer head, and such ink supply mechanism is not suitable for use with a small-size printer head.

Accordingly, it is desirable to provide an ink-supplied wire dot matrix printer head which overcomes these problems associated with the prior art.

SUMMARY OF THE INVENTION

Generally speaking, in accordance with the present invention, there is provided an ink-supplied wire dot matrix printer head having actuating wires. Ink is supplied to the distal ends of the wires which are displaced into contact with a sheet of print paper to transfer the ink to the sheet and thereby form ink dots thereon. The ink-supplied wire dot matrix printer head includes a wire guide member having a wire guide hole for guiding the distal end of the wire, an ink tank containing an ink absorbing body therein and, an ink supply port in which a portion of the wire guide member is inserted. The wire guide member has a capillary ink path communicating with a side of the wire and supplied with ink from the ink absorbing body.

It is an object of the present invention to provide a high-quality and highly reliable ink-supplied wire dot matrix printer head of a simple construction which is capable of supplying a stable and appropriate quantity of ink from an ink tank to the distal ends of wires and is less subject to the influence of environmental changes such as temperature variations.

Still other objects, features and advantages of the present invention will become more apparent from the following description when taken in conjunction with the accompanying drawings in which preferred embodiments of the present invention are shown by way of illustrative example and not in a limiting sense.

The invention accordingly comprises the several steps and relation of one or more of such steps with respect to each of the others, and the apparatus embodying features of construction, combinations of elements and arrangement of parts which are adopted to effect such steps, all as exemplified in the following detailed disclosure, and the scope of the invention will be indicated in the claims.

BRIEF DESCRIPTION OF THE DRAWINGS

For a full understanding of the invention, reference is had to the following description taken in connection with the accompanying drawings, in which:

FIG. 4 is a perspective view, partly cut away, of an ink tank according to the present invention;

FIG. 5 is a side elevational view showing the manner in which said ink tank is mounted in place;

FIG. 6 is a vertical cross-sectional view of an ink guide according to another embodiment of the present invention;

FIG. 7 is an exploded perspective view of an ink guide according to still another embodiment of the present invention;

FIG. 8 is an exploded perspective view of an ink tank according to a still further embodiment of the present invention;

FIG. 9 is a perspective view, partly broken away, of a one embodiment of the ink tank in accordance with the invention;

DESCRIPTION OF THE PREFERRED EMBODIMENTS

A printer head according to the present invention is used in four-color printer plotter and a color image printer and has four-color ink systems and wires corresponding respectively to four ink colors. The four-color printer plotter employs black, red, green, and blue inks, and moves the head or a sheet of print paper or both and then projects a wire corresponding to a desired one of the colors against the print paper at a prescribed position thereon to form an ink dot. Desired characters and figures can thus be recorded by repeating the above cycle. In a color image printer using inks of four colors, that is, black, red, green, and blue, a sheet of print paper is scanned by a printer head in a direction perpendicular to the direction of feed of the print paper to form one-dot line in one scanning stoke, and the print paper is fed along by line pitches to record images. In seven-color printers, inks of four colors, that is, black, yellow, magenta, and cyan are used, and the colors of red, green, and blue are formed on a sheet of print paper by superposing inks of two out of the three desired colors other than black, thereby recording color images of seven colors.

Figure 11:
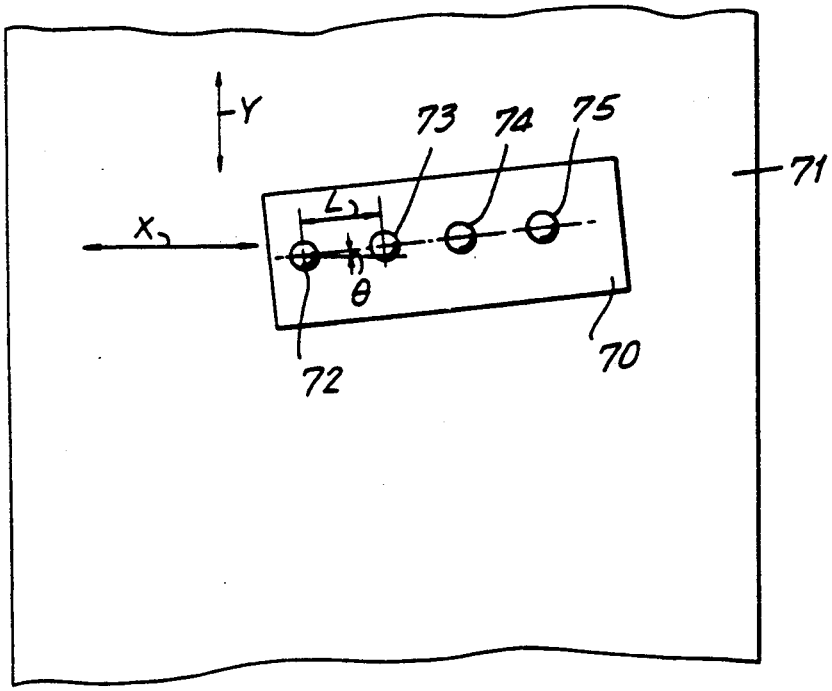
FIG. 11 is a schematic view of an arrangement of wires according to the present invention used with a seven-color printer.

The construction of a seven-color printer is schematically shown in FIG. 11. A printer head 70 is movable back and forth in the direction of the arrow X, and a sheet of print paper 71 is fed along successively by one line pitch in the direction of the arrow Y. An array of wire positions 72, 73, 74, 75 on the printer head 70 extends along a straight line inclined at an angle with respect to the scanning directions X, the wire positions being spaced in the direction Y at a pitch of L sin $\theta$. Yellow-ink, magenta-ink, cyan-ink, and black-ink wires are located in the positions 72, 73, 74, and 75, respectively, to effect color-image printing free from undesired color mixing. Since a dot of one color is put on a dot of another color for mixed color formation, seven-color image printers are generally liable to suffer from unwanted color mixing because the ink of the former color is applied to the wire carrying the ink of the later color. According to the printer construction of FIG. 11, the ink of yellow which is most susceptible to the influence of the inks of the other colors is first applied to the print paper to prevent the inks of the other colors from being attached to the tip end of the wire carrying the yellow ink, thus avoiding the mixture of the yellow ink with the inks of the other colors. Also as seen in FIG. 11, angle $\theta$ is an angle selected to permit adjacent wire positions to be partially out of registration with each other in a direction normal to the direction of printer head displacement (scanning) relative to paper 71 (direction of arrow X).

The present invention is concerned primarily with the printer head, and no further detailed description of the overall printer construction will be given.

Figure 1:
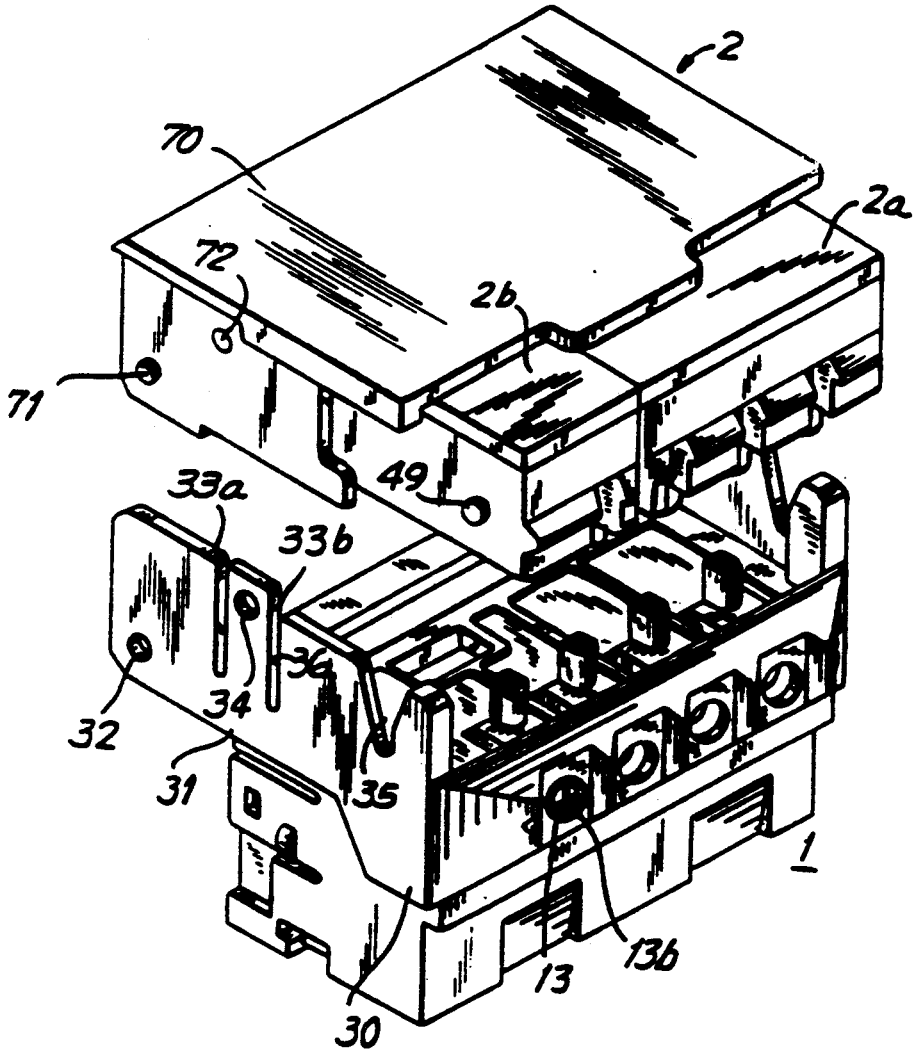
FIG. 1 is an exploded perspective view of a printer head according to an embodiment of the present invention.
Figure 2:
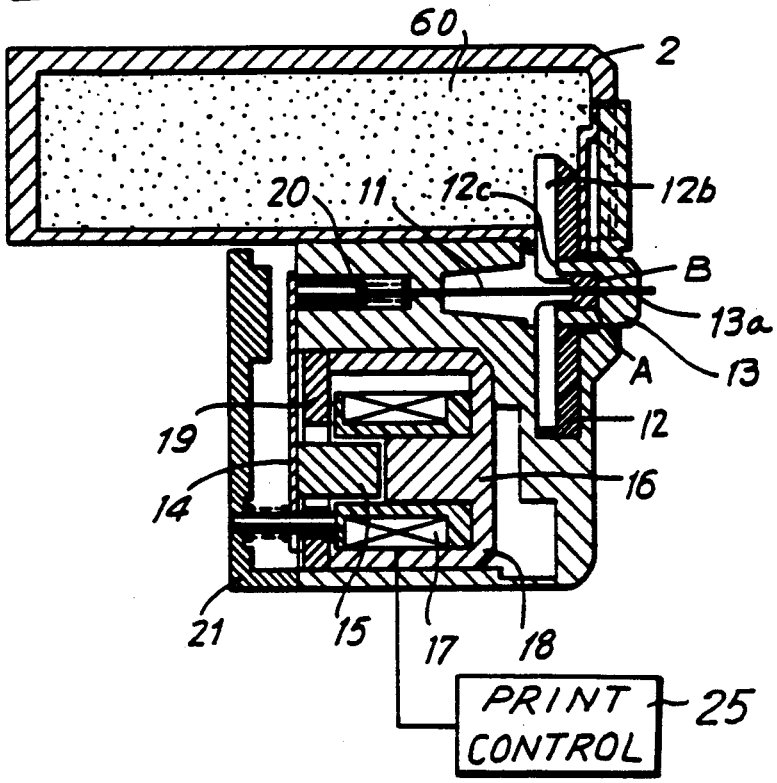
FIG. 2 is a vertical cross-sectional view of the printer head shown in FIG. 1.

FIG. 1 is an exploded perspective view of a printer head, and FIG. 2 is a vertical cross-sectional view of the printer head constructed in accordance with the invention. An ink tank, shown generally as 2, is detachably mounted by a holder 70 on top of a printer head body 1. The ink tank 2 is of a double construction composed of a first ink tank **2*b* for holding black ink and a second ink tank 2*a* which is divided into three sections for color inks. The inks are impregnated in ink-impregnated members 60 of a porous material which are enclosed in the ink tank 2**.

For each ink, the printer head body 1 has in its front portion an ink supply guide 12, shown in FIG. 2, having ink guide grooves **12*b* with ends leading to the ink-impregnated member 60 and a wire guide 13 having a wire guide hole 13*a* in which a wire 11 is partly disposed. The ink supply guide 12 and the wire guide 13 jointly form an ink path from the ink tank 2 to the distal or tip end of the wire 11**. The illustrated printer head is constructed for use in a four-color printer plotter or a four-color image printer, and there are employed four wires corresponding respectively to the four colors.

A wire driver unit for each wire 11 includes a magnetic circuit comprising a yoke 18 having a coil core 16 around which a coil 17 is wound a yoke plate 19, and a plunger 15. Coil 17 is energized by a signal from print control 25, shown schematically in FIG. 2, permitting control over the time and sequence of the driving of each wire 11. Movement of the plunger 15 is transmitted through a clapper 14 to the wire 11. The wire driver unit is covered with a cover 21 which limits the stroke of the clapper 14. In a standby position, the tip end of the wire is located back from a distal end surface of the wire guide 13, and the wire length is selected such that an ink meniscus formed in a front portion of the wire guide hole **13*a*** covers the tip end of the wire.

Figure 3:
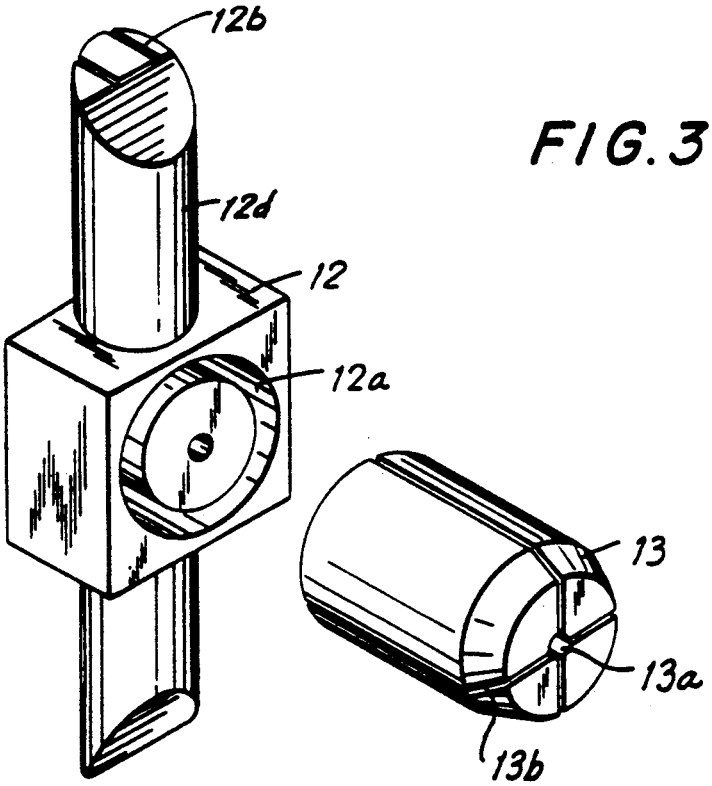
FIG. 3 is an exploded perspective view of an ink guide according to the present invention.

An ink guide assembly, which comprises the ink supply guide 12 and the wire guide 13, will be described in greater detail with reference to FIG. 3.

The ink supply guide 12 has axial ink guide grooves **12*b* leading to the ink-impregnated member 60. Each of the ink guide grooves 12*b* has a width and a depth selected such that ink will be supplied continuously from the ink tank 2 as described later on. The ink supply guide 12 has on a front surface a circular groove 12*a* connected to the ink guide grooves 12*b* through an inner portion 12*c* (FIG. 2). An end of wire guide 13 is placed in the circular groove 12*a*, defining gaps indicated at A, B (FIG. 2). There is only a small gap between the wire 11 and the peripheral surface defining the wire guide hole 13A in the wire guide 13. The ink is guided by capillary action from the ink tank 2 through the ink guide grooves 12*b* in the ink supply guide 12, and then through the gaps A, B between the ink supply guide 12 and the wire guide 13 to the tip end of the wire 11**.

Any excessive ink on the front surface of the wire guide 13 is drawn under capillary attraction into cross-sectionally V-shaped collection grooves **13*b* defined in the front and side surfaces of the wire guide 13 and returned into the tank supply guide 12** without smearing the print paper.

The ink tank 2 will now be described in detail with reference to FIG. 4.

The ink tank 2, or each ink tank **2*a*, 2*b*, comprises a tank body 40, two ink-impregnated members 61, 62 of a porous material placed in the space in the ink tank body 40, and a lid 50. Ink impregnated members are impregnated with ink under low atmospheric pressure ranging from 5 to 10 mmHg, so that air remaining in the porous ink-impregnated members will be reduced as much as possible to increase the amount of impregnated ink. The ink tank body 40 has a bottom 40*a* including a front ink supply port 41 and a front wall air hole 42 defined in a stepped portion thereof. The ink supply guide 12 projecting from the printer head body has an arm 12*d* inserted in the ink supply port 41. The bottom 40*a* of the ink tank body has in its raised surface a plurality of slots 45*a*, 45*b*, 45*c* communicating with the ink supply port 41** in confronting relation to the ink supply grooves 12*b* defined in the arm 12*d* of the ink supply guide 12. Although not shown, the slots 45*a*, 45*b* are joined together to form a single slot, which together with the slot 45*c* guides the ink into the ink supply grooves 12*b*. When arm 12*d* of ink supply guide 12 is inserted in ink supply port 41, it fills the port 41 as shown in FIG. 2 and the periphery of grooves 12*b* adjacent the ink absorbing member 62 actually defines the ink supply port. The ink tank body 40 also has a side wall 40*c* having on its inner wall a plurality of vertical ridges 47 having lower ends held against the bottom 40*a* and upper ends kept out of contact with the lid 50. The ink tank body 40 further has a front partition 48 disposed behind the air hole 42 and in front of the ink supply port 41 and having one end joined to the side wall 40*c*. The tank lid 50 has on a lower surface thereof a plurality of longitudinal ridges 51.

The space or volume defined by the bottom 40*a*, the side wall 40*c*, the partition 48, and the lid 50 of the tank body 40 accommodates therein the two porous members 61, 62 as double layers. Porous members 61 and 62 are held in contact only by the raised surface 44 of the bottom 40*a*, the vertical ridges 47 of the side wall 40*c*, the partition 48, and the ridges 51 of the lid 50. Porous members 61 and 62 have different average pore sizes or diameters. The porous member 61 which has a larger average pore diameter is placed on top of the other porous member 62.

In the ink guide assembly and the ink tank thus constructed, the capillary attraction is successively greater along the ink path, that is, from the porous member 61 having the larger average pore size to the porous member 62 having a smaller average pore size, to the ink guide slots 45 defined in the raised surface of the bottom of the ink tank body, to the ink guide grooves 12*b* defined in the ink supply guide arm 12*d*, to the gaps A, B between the ink supply guide 12 and the wire guide 13, and to the gap between the wire guide 13 and the wire 11. The above capillary attraction path can be achieved by selecting elements having the following dimensions:

The average pore size of porous member 61: 0.4 mm
The average pore size of porous member 62: 0.3 mm
The width of the ink guide slots 45: 0.12 , mm
The width of the ink guide grooves 12*b*: 0.1 mm
The gap between the ink supply guide 12 and the wire guide 13: 0.1 mm
The gap between the surface defining the wire guide hole 13*a* and the wire 11: 0.01 mm A construction for removably attaching the ink tank 2 will be described with reference to FIGS. 1 and 5.

The head body 1 has a frame 30 including side walls extending from upper and back portions of the head body 1 and serving as a holder support 31. The holder support 31 has a holder support hole 32, a leaf spring 36 defined by two vertical recesses 33*a*, 33*b* and having a holder attachment hole 34, and a guide slot 35. A holder 70 has on each of its sides a cylindrical projection 71 rotatably engaging in the holder support hole 32 in the head frame 30 and a semispherical projection 72 engaging in the holder attachment hole 34. Each of the ink tanks 2*a*, 2*b* has a side disposed closer to the holder support 31 and having a cylindrical projection 49 engaging a lower edge of the guide slot 35.

The ink tank can be attached and detached through the above construction in the following manner:

The holder 70 is supported in the position shown in FIG. 5, and the ink tank 2 is inserted into the holder 70 in the direction of the arrow C. At this time, the ink tank 2 is not required to be accurately positioned in the holder 70 and hence can easily be inserted into the holder 70. Then, the holder 70 is turned in the direction of the arrow D to bring the projection 49 on the side of the ink tank 2 into contact with an edge of the guide slot 35 in the head frame 30, whereupon the ink tank 2 is positioned with respect to the head frame 30. Now, the ink supply port 41 is positioned correctly above the arm 12*d* of the ink supply guide 12 projecting upwardly from the head body. Continued turning movement of the holder 70 causes the arm 12*d* to engage in the ink support port 41 and be inserted into the ink tank 2. The semispherical projection 72 on the side of the holder 70 on each side of the tank holder 70 engages and spreads the leaf springs 36 apart from each other. The semispherical projections 72 finally engage in the attachment holes 34 in the leaf springs 36, whereupon the leaf springs 36 return to the vertical positions to retain the holder 70 securely in position. At this time, the ink guide slots 45 on the bottom 40*a* of the ink tank 2 are disposed in confronting relation to the ink guide grooves 12*b* in the arm 12*d* of the ink supply guide 12, thus forming the ink path from the ink tank to the printer head body. The ink tank 2 can be removed in a procedure which is a reversal of the above attachment process.

Operation will now be described.

First, printing operation of the printer head will briefly be described.

Referring to FIG. 2, when the coil 17 is energized, by the signal from print control 25 the plunger 15 confronting the coil core 16 is attracted. The clapper 14 to which the plunger 15 is secured moves to project the wire 11 which engages a distal end of the clapper 14. The tip end of the wire 11 projects through the ink meniscus, carries ink thereon, and hits a sheet of print paper (not shown) to transfer the ink to the printer paper. When the wire 11 is in a standby position, the tip end thereof is located inside of the end surface of the wire guide 13 so that an ink meniscus is formed in front of the tip end of the wire 11. Accordingly, ink is attached successively to the tip end of the wire 11 as the latter is projected and retracted. The transfer of ink to the tip end of the wire, and other details of an inked-wire dot matrix printing process are described in U.S. Pat. No. 4,456,393 issued Jun. 26, 1984, which is incorporated by reference and thus will not be described here in greater detail.

Operation of the ink supply mechanism of the inked-wire dot matrix printer head according to the present invention will now be described.

For obtaining a proper dot density in inking of an ink dot matrix printing system, it is necessary to apply a continuous appropriate quantity of ink to the tip end of the wire. Therefore, the wire guide hole should have a proper dimension in the vicinity of the wire tip end and a proper amount of ink, without excess or shortage, can be supplied from the ink tank.

In the foregoing printer head construction, the ink guide path from the ink tank 2 to a position in the vicinity of the wire tip end is composed of slots, grooves, and gaps. By selecting suitable dimensions of the widths of the slots, grooves, and gaps, an amount of ink necessary for printing can be guided without an overflow under appropriate capillary attraction. Since the gap between the wire guide 13 and the ink supply guide 12 can be dimensioned to retain ink therein under capillary attraction. an appropriate quantity of ink can be supplied even when the ink supply from the ink supply grooves 12*a* suffers an ink shortage due to increased use of ink.

The dimensions of the ink supply grooves and gaps, the hole diameters of the porous members 61, 62, and the widths of the slots 45 are selected such that the capillary attraction is progressively greater along the ink path. Therefore, ink will not be interrupted in the ink path as described below.

As ink is consumed from the ink tank 2 during printing, ink flows from the porous member 62 through the ink guide grooves 12*b*, or through the slots 45 and the ink guide grooves 12*b* into the printer head body. Since the ink moves transversely across the porous member 62 at this time, the distance that the ink moves through the porous member 62 is small and no ink interruption occurs. When the ink supply in the porous member 62 is exhausted, a pressure difference develops immediately between the ink in the porous member 61 and the ink in the porous member 62. This is due to the difference between their average hole diameters, and the same quantity of ink as consumed is supplied from the porous member 61 to the porous member 62. No ink interruption takes place at this time since the ink moves transversely in and across the porous member 61. The amount of ink retained in the porous member 62 thus remains substantially the same as ink is fed out. Therefore, as the printing operation progresses, the ink in the porous member 61 is first used up, and then the ink in the porous member 62 is used up.

The ink guide mechanism in the printer head body operates to the same advantage. When ink flow in the ink path is interrupted due to vibrations or the like, the blocked ink is moved forward until it mixes with a preceding mass of ink since the capillary attraction is greater in the ink path than in the ink tank. Since the capillary attraction is greater in the vicinity of the tip end of the wire than the ink path where the ink flow is blocked, ink is not retracted from the tip end of the wire. Hence, the dot density will not be rendered unstable even momentarily, so that all ink on the wire tip end can be used up.

FIG. 9 of the accompanying drawings illustrates an embodiment of the ink tank construction in accordance with the invention with an ink-impregnated member 160 such as of a porous material being enclosed in tank 140. The illustrated ink tank construction is of a simple shape and can supply a suitable amount of ink to a printer head body under appropriate capillary attraction by the ink-impregnated member. The ink tank can be impregnated with a large quantity of ink while preventing unwanted ink outflow from an air hole 142 and an ink supply port 141.

When ink is supplied from the ink tank of such a construction, ink in the tank remote from the ink supply port flows toward the ink supply port under a pressure difference developed between ink close to the ink supply port and ink remote therefrom as capillary attraction of the ink-impregnated member in the vicinity of the ink supply port is increased due to ink consumption. However, as can be seen in porous materials, ink-impregnated members are generally subjected to an increased resistance to ink flow and interrupted ink paths preventing a smooth ink flow as the quantity of impregnated ink is reduced. If the ink flow is blocked until a pressure differential sufficient to move ink in the ink tank is produced, then ink remote from the ink supply port remains retained and unused, resulting in a short ink supply duration.

Figure 10:
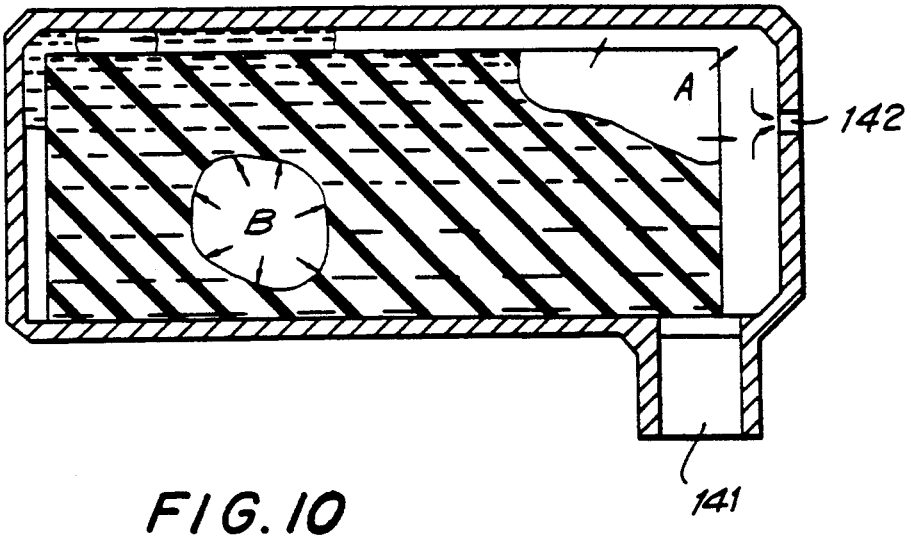
FIG. 10 is a schematic view illustrative of the manner in which air trapped in the ink tank of FIG. 9 is expanded.

As shown schematically in FIG. 10, the ink tank frequently tends to trap air pockets in the ink-impregnated member. When ambient temperature rises or atmospheric pressure is lowered under such a condition, air communicating directly with the air hole expands and is discharged out of the air hole as indicated by arrows A without applying any pressure on impregnated ink, whereas the completely trapped air is expanded as indicated by the arrows B while moving the ink surrounding it. When such air pocket reaches the ink supply port, an undesired ink outflow occurs. This causes a smear or ink spot on a sheet of print paper, or ink finds its way into a printer head mechanism, resulting in a malfunction.

With the ink tank construction of FIG. 4, the ink-impregnated members are supported on the ridges in the ink body, the ink-impregnated members are surrounded by a layer of air which leads to ambient air through the air hole. Since ink is impregnated under a low pressure, there is substantially no air layer or pocket enclosed by ink in the ink-impregnated members. Therefore, any expansion of air in the tank caused by a temperature rise or a reduction in atmospheric pressure is released through the air hole, so that the pressure in the tank is equalized to atmospheric pressure and does not force the ink out of the ink tank.

The ink tank of the invention is therefore free from an ink outflow due to variations in temperature and atmospheric pressure, and capable of uniformly supplying ink.

The ink tank and ink guide path for supplying ink have dimensions dependent on the accuracy of the shapes of the components. Since the components can be formed easily with high dimensional accuracy by molding, the ink tank and ink guide path are highly dimensionally accurate and can supply ink uniformly. The ink tank and ink guide path can easily be assembled as they are composed of a small number of parts. They are free from wear and deformation for a long period of use and can keep initial performance partly because of the lubrication capability of ink.

FIG. 6 shows an ink guide member 12' according to another embodiment of the present invention. The ink guide member 12' is of an integral construction comprising the ink supply guide 12 and the wire guide 13 described in the preceding embodiment. The ink guide member 12' has an ink guide groove 12'*b* capable of guiding and holding ink for application to wire hole 12'*a*. The ink guide member 12' operates in the same manner as described with reference to the foregoing embodiment.

FIG. 7 is an exploded perspective view of an ink guide member 12'' according to still another embodiment of the present invention. The ink guide member 12'' includes an ink guide porous member 12''*e* disposed in the ink guide groove 12''*b* and serving as an extension of the ink-impregnated members in the ink tank into the ink guide path. Operation of the ink guide member 12'' is essentially the same as that of the previous embodiments.

FIG. 8 is an exploded perspective view of an ink tank 2'' according to another embodiment of the present invention. The parts other than a porous member 60'' are the same as those in the embodiment shown in FIG. 4. The porous member 60'' has different front and rear thicknesses so that the thicker front portion is compressed by the tank lid 50 when the porous member 60'' is filled in the tank body 40. Therefore, even if the porous member 60'' has uniform hole diameters, the front portion thereof has a smaller average hole diameter with the hole diameter becoming progressively greater toward the rear portion at the time the porous member 60'' is placed in ink tank body 40. The porous member 60'' is structurally equivalent to a plurality of porous sheet layers of different average hole diameters which are placed in the ink tank body 40 with the average hole diameters member 60''. Therefore, operation of the porous member 60'' is basically the same as that of the porous members 61, 62 shown in FIG. 4. Compression in the vicinity of the ink supply port is also achieved where the ink absorbing member overlies the opening (141) in the tank as shown in FIGS. 9 and 10, since arm **12*d* of ink supply guide 12 is inserted through the opening into compressing engagement with the ink absorbing member in such a construction (compare FIGS. 2, 4, 9 and 10**).

While in the foregoing embodiment of FIG. 1 the ink tank is placed above the printer head, the tank may be located below the wires to achieve a stable printing density through the ink guiding process according to the present invention.

With the present invention, ink can be uniformly supplied through a simple construction from an ink tank to the tip end of a wire, and ink is uniformly attached to the wire tip end for producing a uniform and proper ink dot density. In the printer head of the invention, ink flow will not be interrupted in an ink guide path and prevents an ink supply failure. A quantity of ink absorbed in the ink guide path is smaller than would be absorbed with a conventional arrangement in which a porous member is used to apply ink directly to the tip end of the wire. Therefore, any wasted ink which is not used for printing is of a small quantity, and all the ink in an ink tank can effectively be used for printing. When the ink tank runs short of ink, and the ink in the tank is rendered highly viscous by being dried at high temperature, or is solidified and thus failing to supply ink, a cartridge ink tank can be mounted in place so that fresh ink can immediately be supplied to the wire tip end for resuming desired printing operation.

According to the printer head of the present invention, no ink flow occurs due to variations in temperature and atmospheric pressure and a uniform ink dot density is produced. Unintentional ink flow out of the ink tank is avoided, thus avoiding smearing the print paper with the undesired ink spots. Ink will not enter the printer head mechanism, preventing malfunctioning. The cartridge ink tank can easily be detached and attached for ink replenishment.

Since the ink supply system of the invention is simple in construction, it takes up a small space. Where a multicolor printer head employs ink supply systems of the invention, the ink supply systems for different ink colors can be spaced widely so that mixing of colors can be avoided.

It will thus be seen that the objects set forth above, among those made apparent from the preceding description are efficiently attained and, since certain changes may be made in carrying out the above construction and method set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall there between.

What is claimed is:

1. A dot matrix printer comprising:

printing means for applying ink in a dot matrix to effect printing; and an ink supply means for delivering ink to said printing means comprising:

an ink-supply tank;

an ink absorbing member formed of a porous material contained within said ink-supply tank; and means projecting into said ink-supply tank and formed with an opening for receiving and transmitting ink from said ink absorbing member for delivery to said printer head, said ink absorbing member having a surface facing said opening, at least the entire region of said ink absorbing member of said surface facing the opening of said ink receiving and transmitting means being compressed so as to change the porosity of said region relative to at least another region of the ink absorbing member.

2. The dot matrix printer of claim 1, wherein said ink-supply tank includes a wall facing said ink receiving and transmitting means, said ink absorbing member being compressingly contained in the space intermediate said wall and said ink receiving and transmitting means.

3. The dot matrix printer of claim 2, wherein said wall of said ink-supply tank facing said ink receiving and transmitting means is a cover means bearing on said ink absorbing member when assembled to said ink-supply tank to at least in part apply a compressive force to effect compression of said ink absorbing member.

4. The dot matrix printer of claim 2, wherein said ink absorbing member carries substantially all of the ink in said ink-supply tank when said ink-supply tank is filled to the designed capacity of the ink-supply tank, said ink-supply tank including an inner wall surface having projections to provide a space between said ink absorbing member and said wall surface.

5. The dot matrix printer of claim 4, and including ink impregnated in the ink absorbing member under a pressure sufficiently low to substantially eliminate air bubbles in the ink absorbing member.

6. The dot matrix printer of claim 4, and including means for providing ambient air to the space between said ink absorbing member and said wall surface.

7. The dot matrix printer of claim 6, wherein said wall of said ink-supply tank facing said ink receiving and transmitting means is a cover means bearing on said ink absorbing member when assembled to said ink-supply tank to at least in part apply a compressive force to effect compression of said ink absorbing member, at least a portion of said projections extending from the inner wall surface of said cover means.

8. The dot matrix printer of claim 4, wherein said projections are formed in an inner wall surface of said wall of said ink-supply tank facing said ink receiving and transmitting means.

9. The dot matrix printer of claim 8, and including means for providing ambient air to the space between said ink absorbing member and said wall surface.

10. The dot matrix printer of claim 1, and including ink impregnated in the ink absorbing member under a pressure sufficiently low to substantially eliminate air bubbles in the ink absorbing member.

11. The dot matrix printer of claim 1, wherein said ink absorbing member comprises at least two separate porous members disposed as stacked layers, one of said porous members which is closer to said ink receiving and transmitting means being made of a porous material having a smaller average pore size than the porous material of the other porous member more remote from said ink receiving and transmitting means.

12. The dot matrix printer of claim 1 wherein the ink absorbing member is held in compression in the vicinity of said ink receiving and transmitting means by said ink-supply tank.

13. A dot matrix printer comprising:

printing means for applying ink in a dot matrix to effect printing; and an ink supply means for delivering ink to said printing means comprising:

an ink-supply tank;

an ink absorbing member formed of a porous material contained within said ink-supply tank, said ink absorbing member carrying substantially all of the ink in said ink-supply tank when said ink-supply tank is filled to the designed capacity of the ink-supply tank; and means projecting into said ink-supply tank and formed with an opening for receiving and transmitting ink from said ink absorbing member for delivery to said printer head, said ink absorbing member having a region facing said opening, at least the region of said ink absorbing member facing the opening of said ink receiving and transmitting means being compressed relative to at least another region of the ink absorbing member.

14. The dot matrix printer of claim 13, said ink supply tank including an inner wall surface having projections to provide a space between said ink absorbing member and said wall surface and including means for providing ambient air to the space between said ink absorbing member and said wall surface.

15. A dot matrix printer, comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank; and an ink absorbing member substantially filling said ink-supply tank and being formed of a porous material mounted within said tank, said ink absorbing member having a region facing said opening and being compressingly contained by the ink-supply tank against the ink-supply delivery port so that at least the region of the ink absorbing member facing said opening is compressed relative to at least another region of the ink absorbing member.

16. The dot matrix printer of claim 15, wherein said ink-supply tank includes a wall facing said ink-supply delivery port, at least a portion of the ink absorbing member being compressingly contained in the space between said ink-supply delivery port and said wall of said ink tank.

17. The dot matrix printer of claim 16, wherein said wall of said ink-supply tank facing said ink-supply delivery port is a cover means bearing on said ink absorbing member when assembled to said ink-supply tank to at least in part apply a compressive force to effect compression of said ink absorbing member.

18. The dot matrix printer of claim 15, and including ink impregnated in the ink absorbing member under a pressure sufficiently low to substantially eliminate air bubbles in the ink absorbing member.

19. The dot matrix printer of claim 15, wherein said ink absorbing member comprises at least two separate porous members disposed as stacked layers, one of said porous members which is closer to said ink-supply delivery port being made of a porous material having a smaller average pore size than the porous material of the other porous member more remote from said ink-supply delivery port.

20. The dot matrix printer of claim 16, wherein said ink absorbing member carries substantially all of the ink in said ink-supply tank when said ink-supply tank is filled to the designed capacity of the ink-supply tank, said ink-supply tank including an inner wall surface having projections to provide a space between said ink absorbing member and said wall surface.

21. The dot matrix printer of claim 20, and including means for providing ambient air to the space between said ink absorbing member and said wall surface.

22. The dot matrix printer of claim 21, wherein said wall of said ink-supply tank facing said ink-supply delivery port is a cover means bearing on said ink absorbing member when assembled to said ink-supply tank to at least in part apply a compressive force to effect compression of said ink absorbing member, said ink-supply tank cover including an inner wall surface having projections to provide a space between said ink absorbing member and said wall surface, at least a portion of said projections extending from the inner wall surface of said cover.

23. The dot matrix printer of claim 20, wherein said projections are formed in an inner wall surface of said wall of said ink-supply tank facing said ink-supply delivery port.

24. The dot matrix printer of claim 23, and including means for providing ambient air to the space between said ink absorbing member and said wall surface.

25. The dot matrix printer of claim 20, and including ink impregnated in the ink absorbing member under a pressure sufficiently low to substantially eliminate air bubbles in the ink absorbing member.

26. A dot matrix printer comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank; and an ink absorbing member formed of a porous material mounted within said tank, said ink absorbing member having a region facing said opening and being compressingly contained by the ink-supply tank against the ink-supply delivery port so that at least the region of the ink absorbing member facing said opening is compressed relative to at least another region of the ink absorbing member, said ink absorbing member carrying substantially all of the ink in said ink-supply tank when said ink-supply tank is filled to the designed capacity of the ink-supply tank.

27. The dot matrix printer of claim 26, said ink supply tank including an inner wall surface having projections to provide a space between said ink absorbing member and said wall surface and including means for providing ambient air to the space between said ink absorbing member and said wall surface.

28. A dot matrix printer, comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank and a wall facing said ink-supply delivery port; and an ink absorbing member substantially filling said ink-supply tank and being formed of a porous material mounted within said tank, said ink absorbing member having a region forming said opening and being compressingly contained in the space defined between said wall facing said ink-supply delivery port and said ink-supply delivery port so that at least the region of the ink absorbing member facing said opening is compressed relative to at least another region of the ink absorbing member.

29. The dot matrix printer of claim 28, wherein said wall of said ink-supply tank facing said ink-supply delivery port is a cover means bearing on said ink absorbing member when assembled to said ink-supply tank to at least in part apply a compressive force to effect compression of said ink absorbing member.

30. The dot matrix printer of claim 28, and including ink impregnated in the ink absorbing member under a pressure sufficiently low to substantially eliminate air bubbles in the ink absorbing member.

31. A dot matrix printer comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank and a wall facing said ink-supply delivery port; and an ink absorbing member formed of a porous material mounted within said tank, said ink absorbing member having a region forming said opening and being compressively contained in the space defined between said wall facing said ink-supply delivery port and said ink-supply delivery port so that at least the region of the ink absorbing member facing said opening is compressed relative to at least another region of the ink absorbing member, said ink absorbing member carrying substantially all of the ink in said ink-supply tank when said ink-supply tank is filled to the designed capacity of the ink-supply tank.

32. The dot matrix printer of claim 31, said ink supply tank including an inner wall surface having projections to provide a space between said ink absorbing member and said wall surface and including means for providing ambient air to the space betwen said ink absorbing member and said wall surface.

33. The dot matrix printer of claim 32, wherein said wall of said ink-supply tank facing said ink-supply delivery port is a cover means bearing on said ink absorbing member when assembled to said ink-supply tank to at least in part apply a compressive force to effect compression of said ink absorbing member, at least a portion of said projections extending from the inner wall surface of said cover means.

34. The dot matrix printer of claim 31, and including an inner wall surface of said wall of said ink-supply tank facing said ink-supply delivery port having projections to provide a space between said ink absorbing member and said wall surface.

35. The dot matrix printer of claim 34, and including means for providing ambient air to the space between said ink absorbing member and said wall surface.

36. The dot matrix printer of claim 31, and including ink impregnated in the ink absorbing member under a pressure sufficiently low to substantially eliminate air bubbles in the ink absorbing member.

37. A dot matrix printer comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank; and an ink absorbing member formed of a porous material mounted within said ink-supply tank and having a surface facing said opening of said ink-supply delivery port, at least the entire region of said ink absorbing member at said surface facing said opening of said ink-supply delivery port being compressed so as to change the porosity of said region relative to at least another region of the ink absorbing member.

38. The dot matrix printer of claim 37, wherein said ink-supply tank includes a wall facing said ink-supply delivery port, at least a portion of the ink absorbing member being compressingly contained in the space between said ink-supply delivery port and said wall of said ink tank.

39. The dot matrix printer of claim 38, wherein said wall of said ink-supply tank facing said ink-supply delivery port is a cover means bearing on said ink absorbing member when assembled to said ink-supply tank to at least in part apply the compressive force to effect compression of said ink absorbing member.

40. The dot matrix printer of claim 38, wherein said ink absorbing member carries substantially all of the ink in said ink-supply tank when said ink-supply tank is filled to the desired capacity of the ink-supply tank, said ink-supply tank including an inner wall surface having projections to provide a space between said ink absorbing member and said wall surface.

41. The dot matrix printer of claim 40, and including means for providing ambient air to the space between said ink absorbing member and said wall surface.

42. The dot matrix printer of claim 41, wherein said wall of said ink-supply tank facing said ink-supply delivery port is a cover means bearing on said ink absorbing member when assembled to said ink-supply tank to at least in part apply the compressive force to effect compression of said ink absorbing member, at least a portion of said projections extending from the inner wall, surface of said cover means.

43. The dot matrix printer of claim 40, wherein said projections are formed in an inner wall surface of said wall of said ink-supply tank facing said ink-supply delivery port.

44. The dot matrix printer of claim 43, and including means for providing ambient air to the space between said ink absorbing member and said wall surface.

45. The dot matrix printer of claim 40, and including ink impregnated in the ink absorbing member under a pressure sufficiently low to substantially eliminate air bubbles in the ink absorbing member.

46. The dot matrix printer of claim 37, and including ink impregnated in the ink absorbing member under a pressure sufficiently low to substantially eliminate air bubbles in the ink absorbing member.

47. The dot matrix printer of claim 37, wherein said ink absorbing member comprises at least two separate porous members disposed as stacked layers, one of said porous members which is closer to said ink-supply delivery port being made of a porous material having a smaller average pore size than the porous material of the other porous member more remote from said ink-supply delivery port.

48. The dot matrix printer of claim 37, wherein the ink absorbing member is held in compression in the vicinity of said ink-supply delivery port by said ink-supply tank.

49. A dot matrix printer comprising:

printing means for applying ink in a dot matrix to effect printing; and an ink supply means for delivering ink to said printing means comprising:

an ink-supply tank formed with an ink-supply delivery port having an opening for the passage of ink from said ink-supply tank; and an ink absorbing member formed of a porous material mounted within said ink-supply tank and having a region facing said opening of said ink-supply delivery port, at least the region of said ink absorbing member facing said opening of said ink-supply delivery port being compressed relative to at least another region of the ink absorbing member, said ink absorbing member carrying substantially all of the ink in said ink-supply tank when said ink-supply tank is filled to the designed capacity of the ink-supply tank.

50. The dot matrix printer of claim 49, said ink supply tank including an inner wall surface having projections to provide a space between said ink absorbing member and said wall surface and including means for providing ambient air to the space between said ink absorbing member and said wall surface.

51. A method for supplying ink for a dot matrix printer comprising:

providing an ink absorbing member formed of a porous material mounted within an ink-supply tank and substantially filling the ink-supply tank;

providing means projecting into said ink-supply tank and having an opening for receiving and transmitting ink from said ink absorbing member;

compressing said ink absorbing member relative to at least another region thereof at least in the region of the ink absorbing member facing the opening of said ink receiving and transmitting means; and withdrawing said ink from said ink-supply tank through the opening of said ink receiving and transmitting means.

52. The method of claim 51, wherein said compression of said ink absorbing member is effected by the securing of a cover means which bears on the ink absorbing member and faces said ink receiving and transmitting means.

53. The method of claim 51, including the further step of applying ink to said ink absorbing member under a pressure sufficiently low to substantially eliminate air bubbles in the ink absorbing member.

54. The method of claim 51, including the step of forming said ink absorbing member of at least two separate porous members disposed as stacked layers, one of said porous members which is closer to said ink receiving and transmitting means being made of a porous material having a smaller average pore size than the porous material of the other porous member more remote from said ink receiving and transmitting means.

55. The method of claim 51, wherein the step of compressing said ink-absorbing member is by the engagement thereof by said ink tank.

56. A method for supplying ink for a dot matrix printer comprising the steps of:

providing an ink absorbing member formed of a porous material mounted within an ink-supply tank;

providing means projecting into said ink-supply tank and having an opening for receiving and transmitting ink from said ink absorbing member;

providing a space between at least an inner wall surface of the ink-supply tank and the ink absorbing member, and including the further step of providing ambient air to said space;

compressing said ink absorbing member relative to at least another region thereof at least in the entire region at the surface of the ink absorbing member facing the opening of said ink receiving and transmitting means so as to change the porosity of the compressed region; and withdrawing said ink from said ink-supply tank through the opening of said ink receiving and transmitting means.

57. A method for supplying ink for a dot matrix printer comprising:

providing an ink absorbing member formed of a porous material mounted within an ink-supply tank;

applying ink to said ink-supply tank so that said ink absorbing member carries substantially all of the ink that said ink-supply tank was designed to hold;

providing means projecting into said ink-supply tank and having an opening for receiving and transmitting ink from said in absorbing member;

compressing said ink absorbing member relative to at least another region thereof at least in the region of the ink absorbing member facing the opening of said ink receiving and transmitting means; and withdrawing said ink from said ink-supply tank through the opening of said ink receiving and transmitting means.

58. An ink-supply system for a dot matrix printer head comprising:

an ink-supply tank;

an ink absorbing member formed of a porous material contained within said ink-supply tank; and means projecting into said ink-supply tank and formed with an opening for receiving and transmitting ink from said ink absorbing member for delivery to said printer head, said ink absorbing member having a surface facing said opening, at least the entire region of said ink absorbing member at said surface facing the opening of said ink receiving and transmitting means being compressed so as to change the porosity of said region relative to at least another region of the ink absorbing member.

59. The ink-supply system of claim 58, wherein said ink-supply tank includes a wall facing said ink receiving and transmitting means, said ink absorbing member being compressingly contained in the space intermediate said wall said ink receiving and transmitting means.

60. The ink-supply system of claim 59, wherein said wall of said ink-supply tank facing said ink receiving and transmitting means is a cover means bearing on said ink absorbing member when assembled to said ink-supply tank to at least in part apply a compressive force to effect compression of said ink absorbing member.

61. The ink-supply system of claim 59, wherein said ink absorbing member carries substantially all of the ink in said ink-supply tank when said ink-supply tank is filled to the designed capacity of the ink-supply tank, said ink-supply tank including an inner wall surface having projections to provide a space between said ink absorbing member and said wall surface.

62. The ink-supply system of claim 61, and including ink impregnated in the ink absorbing member under a pressure sufficiently low to substantially eliminate air bubbles in the ink absorbing member.

63. The ink-supply system of claim 61, and including means for providing ambient air to the space between said ink absorbing member and said wall surface.

64. The ink-supply system of claim 63, wherein said wall of said ink-supply tank facing said ink receiving and transmitting means is a cover means bearing on said ink absorbing member when assembled to said ink-supply tank to at least in part apply a compressive force to effect compression of said ink absorbing member, at least a portion of said projections extending from the inner wall surface of said cover means.

65. The ink-supply system of claim 61, wherein said projections are formed in an inner wall surface of said wall of said ink-supply tank facing said ink receiving and transmitting means.

66. The ink-supply system of claim 65, and including means for providing ambient air to the space between said ink absorbing member and said wall surface.

67. The ink-supply system of claim 58, and including ink impregnated in the ink absorbing member under a pressure sufficiently low to substantially eliminate air bubbles in the ink absorbing member.

68. The ink-supply system of claim 58, wherein said ink absorbing member comprises at least two separate porous members disposed as stacked layers, one of said porous members which is closer to said ink receiving and transmitting means being made of a porous material having a smaller average pore size than the porous material of the other porous member more remote from said ink receiving and transmitting means.

69. The ink-supply system of claim 58, wherein the ink absorbing member is held in compression in the vicinity of said ink receiving and transmitting means by said ink-supply tank.

70. An ink supply system for a dot matrix printer head comprising:

an ink-supply tank;

an ink absorbing member formed of a porous material contained within said ink-supply tank, said ink absorbing member carrying substantially all of the ink in said ink-supply tank when said ink-supply tank is filled to the designed capacity of the ink-supply tank; and means projecting into said ink-supply tank and formed with an opening for receiving and transmitting ink from said ink absorbing member for delivery to said printer head, said ink absorbing member having a region facing said opening, at least the region of said ink absorbing member facing the opening of said ink receiving and transmitting means being compressed relative to at least another region of the ink absorbing member.

71. The ink supply system of claim 70, said ink supply tank including an inner wall surface having projections to provide a space between said ink absorbing member and said wall surface and including means for providing ambient air to the space between said ink absorbing member and said wall surface.

72. An ink-supply system for a dot matrix printer, comprising:

an ink-supply tank formed with an ink-supply delivery port having an opening for the passage of ink from said ink-supply tank; and an ink absorbing member substantially filling the ink-supply tank and being formed of a porous material mounted within said tank, said ink absorbing member having a region facing said opening and being compressingly contained by the ink-supply tank against the ink-supply delivery port so that at least the region of the ink absorbing member facing said opening is compressed relative to at least another region of the ink absorbing member.

73. The ink-supply system of claim 72, wherein said ink-supply tank includes a wall facing said ink-supply delivery port, at least a portion of the ink absorbing member being compressingly contained in the space between said ink-supply delivery port and said wall of said ink tank.

74. The ink-supply system of claim 73, wherein said wall of said ink-supply tank facing said ink-supply delivery port is a cover means bearing on said ink absorbing member when assembled to said ink-supply tank to at least in part apply a compressive force to effect compression of said ink absorbing member.

75. The ink-supply system of claim 72, and including ink impregnated in the ink absorbing member under a pressure sufficiently low to substantially eliminate air bubbles in the ink absorbing member.

76. The ink-supply system of claim 72, wherein said ink absorbing member comprises at least two separate porous members disposed as stacked layers, one of said porous members which is closer to said ink-supply delivery port being made of a porous material having a smaller average pore size than the porous material of the other porous member more remote from said ink-supply delivery port.

77. An ink-supply system for a dot matrix printer, comprising:

an ink-supply tank formed with an ink-supply delivery port having an opening for the passage of ink from said ink-supply tank; and an ink absorbing member formed of a porous material mounted within said tank, said ink absorbing member having a region facing said opening and being compressingly contained by the ink-supply tank against the ink-supply delivery port so that at least the region of the ink absorbing member facing said opening is compressed relative to at least another region of the ink absorbing member, said ink absorbing member carrying substantially all of the ink in said ink-supply tank when said ink-supply tank is filled to the designed capacity of the ink-supply tank.

78. The ink supply system of claim 77, said ink supply tank including an inner wall surface having projections to provide a space between said ink absorbing member and said wall surface and including means for providing ambient air to the space between said ink absorbing member and said wall surface.

79. The ink-supply system of claim 78, wherein said wall of said ink-supply tank facing said ink-supply delivery port is a cover means bearing on said ink absorbing member when assembled to said ink-supply tank to at least in part apply the compressive force to effect compression of said ink absorbing member, at least a portion of said projections extending from the inner wall surface of said cover means.

80. The ink-supply system of claim 77, and including an inner wall surface of said wall of said ink-supply tank facing said ink-supply delivery port having projections to provide a space between said ink absorbing member and said wall surface.

81. The ink-supply system of claim 80, and including means for providing ambient air to the space between said ink absorbing member and said wall surface.

82. The ink-supply system of claim 77, and including ink impregnated in the ink absorbing member under a pressure sufficiently low to substantially eliminate air bubbles in the ink absorbing member.

83. An ink-supply system for a dot matrix printer, comprising:

an ink-supply tank formed with an ink-supply delivery port having an opening for the passage of ink from said ink-supply tank;

an ink absorbing member formed of a porous material mounted within said tank, said ink absorbing member having a region facing said opening and being compressingly contained by the ink-supply tank against the ink-supply delivery port so that at least the region of the ink absorbing member facing said opening is compressed relative to at least another region of the ink absorbing member; and said ink absorbing member substantially filling said ink-supply tank, said ink-supply tank including an inner wall surface having projections to provide a space between said ink absorbing member and said wall surface.

84. The ink-supply system of claim 83, and including means for providing ambient air to the space between said ink absorbing member and said wall surface.

85. An ink-supply system for a dot matrix printer, comprising:

an ink-supply tank formed with an ink-supply delivery port having an opening for the passage of ink from said ink-supply tank and a wall facing said ink-supply delivery port; and an ink absorbing member substantially filling said ink-supply tank and being formed of a porous material mounted within said tank, said ink absorbing member having a region facing said opening and being compressingly contained in the space defined between said wall facing said ink-supply delivery port and said ink-supply delivery port so that at least the region of the ink absorbing member facing said opening is compressed relative to at least another region of the ink absorbing member.

86. The ink-supply system of claim 85, wherein said wall of said ink-supply tank facing said ink-supply delivery port is a cover means bearing on said ink absorbing member when assembled to said ink-supply tank to at least in part apply a compressive force to effect compression of said ink absorbing member.

87. The ink-supply system of claim 85, and including ink impregnated in the ink absorbing member under a pressure sufficiently low to substantially eliminate air bubbles in the ink absorbing member.

88. An ink-supply system for a dot matrix printer, comprising:

an ink-supply tank formed with an ink-supply delivery port having an opening for the passage of ink from said ink-supply tank and a wall facing said ink-supply delivery port; and an ink absorbing member formed of a porous material mounted within said tank, said ink absorbing member having a region facing said opening and being compressingly contained in the space defined between said wall facing said ink-supply delivery port and said ink-supply delivery port so that at least the region of the ink absorbing member facing said opening is compressed relative to at least another region of the ink absorbing member, said ink absorbing member carrying substantially all of the ink in said ink-supply tank when saidd ink-supply tank is filled to the designed capacity of the ink-supply tank.

89. The ink suppy system of claim 88, said ink supply tank including an inner wall surface having projections to provide a space between said ink absorbing member and said wall surface and including means for providing ambient air to the space between said ink absorbing member and said wall surface.

90. The ink-supply system of claim 89, wherein said wall of said ink-supply tank facing said ink-supply delivery port is a cover means bearing on said ink absorbing member when assembled to said ink-supply tank to at least in part apply a compressive force to effect compression of said ink absorbing member, at least a portion of said projections extending from the inner wall surface of said cover means.

91. The ink-supply system of claim 88, and including an inner wall surface of said wall of said ink-supply tank facing said ink-supply deliverly port having projections to provide a space between said ink absorbing member and said wall surface.

92. The ink-supply system of claim 91, and including means for providing ambient air to the space between said ink absorbing member and said wall surface.

93. The ink-supply system of claim 88, and including ink impregenated in the ink absorbing member under a pressure sufficiently low to substantially eliminate air bubbles in the ink absorbing member.

94. An ink-supply system for a dot matrix printer comprising:

an ink-supply tank formed with an ink-supply delivery port having an opening for the passage of ink from said ink-supply tank; and an ink absorbing member formed of a porous material mounted within said ink-supply tank and having a surface facing said opening of said ink-supply delivery port, at least the entire region of said ink absorbing member at said surface facing said opening of said ink-supply delivery port being compressed so as to change the porosity of said region relative to at least another region of said ink absorbing member.

95. The ink-supply system of claim 94, wherein said ink-supply tank includes a wall facing said ink-supply delivery port, at least a portion of the ink absorbing member being compressingly contained in the space between said ink-supply delivery port and said wall of said ink tank.

96. The ink-supply system of claim 95, wherein said wall of said ink-supply tank facing said ink-supply delivery port is a cover means bearing on said ink absorbing member when assembled to said ink-supply tank to at least in part apply a compressive force to effect compression of said ink absorbing member.

97. The ink-supply system of claim 95, wherein said ink absorbing member carries substantially all of the ink in said ink-supply tank when said ink-supply tank is filled to the designed capacity of the ink-supply tank, said ink-supply tank including an inner wall surface having projections to provide a space between said ink absorbing member and said wall surface.

98. The ink-supply system of claim 97, and including means for providing ambient air to the space between said ink absorbing member and said wall surface.

99. The ink-supply system of claim 98, wherein said wall of said ink-supply tank facing said ink-supply delivery port is a cover means bearing on said ink absorbing member when assembled to said ink-supply tank to at least in part apply a compressive force to effect compression of said ink absorbing member, at least a portion of said projections extending from the inner wall surface of said cover means.

100. The ink-supply system of claim 97, wherein said projections are formed in an inner wall surface of said wall of said ink-supply tank facing said ink-supply delivery port.

101. The ink-supply system of claim 100, and including means for providing ambient air to the space between said ink absorbing member and said wall surface.

102. The ink-supply system of claim 97, and including ink impregnated in the ink absorbing member under a pressure sufficiently low to substantially eliminate air bubbles in the ink absorbing member.

103. The ink-supply system of claim 94, and including ink impregnated in the ink absorbing member under a pressure sufficiently low to substantially eliminate air bubbles in the ink absorbing member.

104. The ink-supply system of claim 94, wherein said ink absorbing member comprises at least two separate porous members disposed as stacked layers, one of said porous members which is closer to said ink-supply delivery port being made of a porous material having a smaller average pore size than the porous material of the other porous member more remote from said ink-supply delivery port.

105. The ink-supply system of claim 94, wherein the ink absorbing member is held in compression in the vicinity of said ink-supply delivery port by said ink-supply tank.

106. An ink-supply system for a dot matrix printer comprising:

an ink-supply tank formed with an ink-supply delivery port having an opening for the passage of ink from said ink-supply tank; and an ink absorbing member formed of a porous material mounted within said ink-supply tank and having a region facing said opening of said ink-supply delivery port, at least the region of said ink absorbing member facing said opening of said ink-supply delivery port being compressed relative to at least another region of said ink absorbing member, said ink absorbing member carrying substantially all of the ink in said ink-supply tank when said ink-supply tank is filled to the designed capacity of the ink-supply tank.

107. The ink supply system of claim 106, said ink-supply tank including an inner wall surface having projections to provide a space between said ink absorbing member and said wall surface and including means for providing ambient air to the space between said ink absorbing member and said wall surface.

108. A method for supplying ink to a dot matrix printer comprising:

providing an ink absorbing member formed of a porous material within an ink-supply tank formed with an ink-supply delivery port having an opening for the passage of ink from the ink-supply tank;

compressing said ink absorbing member relative to at least another region thereof at least in the entire region at a surface of said ink absorbing member facing said opening of said ink-supply delivery port so as to change the porosity of said compressed region; and withdrawing ink from said ink-supply tank through the opening in said ink-supply delivery port.

109. The method of claim 108, wherein said compression of said ink absorbing member is effected by the securing of a cover means which bears on the ink absorbing member and faces said ink-supply delivery port.

110. The method of claim 108, including the further step of applying ink to said ink absorbing member under a pressure sufficiently low to substantially eliminate air bubbles in the ink absorbing member.

111. The method of claim 108, including the step of forming said ink absorbing member of at least two separate porous members disposed as stacked layers, one of said porous members which is closer to said ink-supply delivery port being made of a porous material having a smaller average pore size than the porous material of the other porous member more remote from said ink-supply delivery port.

112. The method of claim 108, wherein the step of compressing said ink-absorbing member is by the engagement thereof by said ink tank.

113. A method for supplying ink to a dot matrix printer comprising the steps of:

providing an ink absorbing member formed of a porous material within an ink-supply tank formed with an ink-supply delivery port having an opening for the passage of ink from the ink-supply tank, said ink absorbing member being selected to substantially fill the ink-supply tank;

compressing said ink absorbing member relative to at least another region thereof at least in the region of said ink absorbing member facing said opening of said ink-supply delivery port; and providing a space between at least an inner wall surface of the ink-supply tank and the ink absorbing member, and including the further step of providing ambient air to said space;

withdrawing ink from said ink-supply tank through the opening in said ink-supply delivery port.

114. A method for supplying ink to a dot matrix printer comprising the steps of:

providing an ink absorbing member formed of a porous material within an ink-supply tank formed with an ink-supply delivery port having an opening for the passage of ink from the ink-supply tank;

applying ink to said ink-supply tank so that said ink absorbing member carrier substantially all of the ink that said ink-supply tank was designed to hold;

compressing said ink absorbing member relative to at least another region thereof at least in the region of said ink absorbing member facing said opening of said ink-supply delivery port; and withdrawing ink from said ink-supply tank through the opening in said ink-supply delivery port.

* * * * *

US005158377C1

(12) EX PARTE REEXAMINATION CERTIFICATE (10213th)

United States Patent
Suzuki et al.

(10) Number: US 5,158,377 C1
(45) Certificate Issued: Jun. 30, 2014

(54) INK-SUPPLY SYSTEM FOR A DOT MATRIX PRINTER

(75) Inventors: Takashi Suzuki, Shiojiri (JP); Masanao Matsuzawa, Shiojiri (JP); Yoshinori Miyazawa, Shiojiri (JP)

(73) Assignee: Seiko Epson Corporation

Reexamination Request:
No. 90/011,817, Aug. 1, 2011

Reexamination Certificate for:

| | |
|---|---|
| Patent No.: | **5,158,377** |
| Issued: | **Oct. 27, 1992** |
| Appl. No.: | **07/620,411** |
| Filed: | **Nov. 30, 1990** |

Related U.S. Application Data

(60) Division of application No. 07/612,010, filed on Nov. 9, 1990, now Pat. No. 5,156,471, which is a continuation of application No. 07/401,539, filed on Aug. 31, 1989, now Pat. No. 4,969,759, which is a continuation of application No. 07/161,216, filed on Feb. 17, 1988, now abandoned, which is a continuation of application No. 07/035,251, filed on Mar. 23, 1987, now abandoned, which is a continuation of application No. 06/873,871, filed on Jun. 12, 1986, now abandoned, which is a continuation of application No. 06/659,816, filed on Oct. 11, 1984, now abandoned.

(30) Foreign Application Priority Data

| | | |
|---|---|---|
| May 22, 1984 | (JP) | 59-102841 |
| May 22, 1984 | (JP) | 59-102842 |
| May 22, 1984 | (JP) | 59-102843 |

(51) Int. Cl.
*B41J 2/23* (2006.01)
*B41J 2/25* (2006.01)

(52) U.S. Cl.
USPC ..... 400/124.1; 400/470

(58) Field of Classification Search
None
See application file for complete search history.

(56) References Cited

To view the complete listing of prior art documents cited during the proceeding for Reexamination Control Number 90/011,817, please refer to the USPTO's public Patent Application Information Retrieval (PAIR) system under the Display References tab.

*Primary Examiner* — Stephen J Ralis

(57) ABSTRACT

An ink-supply system for a dot matrix printer including an ink-supply tank formed with an ink supply delivery port having an opening for passage of ink from the ink-supply tank. An ink absorbing member formed of a porous material is mounted within the ink-supply tank and compressed relative to at least another region of the ink absorbing member at least in the region thereof facing the opening of the ink supply delivery port.

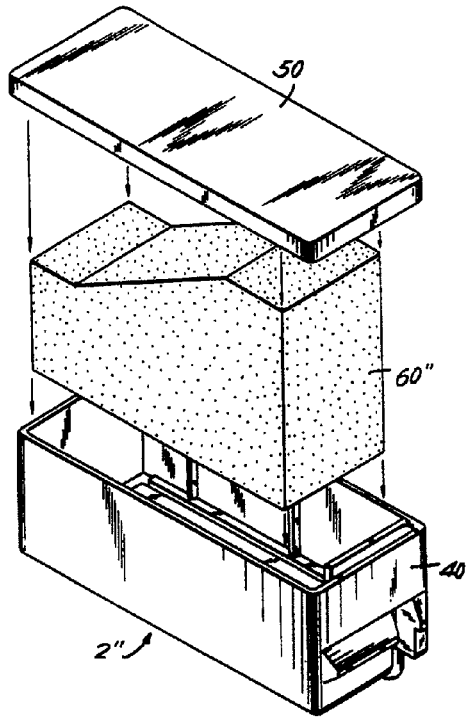

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 83 and 84 are cancelled.

Claims 1-82 and 85-114 were not reexamined.

* * * * *